US009091996B2

(12) United States Patent
Hasegawa et al.

(10) Patent No.: US 9,091,996 B2
(45) Date of Patent: Jul. 28, 2015

(54) MEDIUM CONVEYING DEVICE WITH SKEW CONVEYING MEMBER CLEANER

(75) Inventors: Yousuke Hasegawa, Kanagawa (JP); Michio Tada, Kanagawa (JP); Takashi Abe, Kanagawa (JP); Hisakazu Onoe, Kanagawa (JP); Hiroyuki Suzuki, Kanagawa (JP); Akira Iwasaka, Kanagawa (JP); Makio Uehara, Kanagawa (JP); Toshitaka Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 397 days.

(21) Appl. No.: 12/878,528

(22) Filed: Sep. 9, 2010

(65) Prior Publication Data

US 2011/0142515 A1 Jun. 16, 2011

(30) Foreign Application Priority Data

Dec. 11, 2009 (JP) ..... 2009-282028

(51) Int. Cl.

*G03G 15/00* (2006.01)
*B65H 23/02* (2006.01)
*G03G 21/00* (2006.01)

(Continued)

(52) U.S. Cl.

CPC ..... *G03G 21/00* (2013.01); *B65H 5/062* (2013.01); *B65H 9/166* (2013.01); *G03G 15/6567* (2013.01); *B65H 2301/531* (2013.01); *B65H 2404/14* (2013.01); *B65H 2801/06* (2013.01);

(Continued)

(58) Field of Classification Search

CPC ..... B65H 2301/231; G03G 2215/00561
USPC ..... 400/579; 271/250
See application file for complete search history.

(56) References Cited

U.S. PATENT DOCUMENTS 5,560,467 A * 10/1996 Takemoto et al. ..... 194/207
6,263,175 B1 * 7/2001 Sawada et al. ..... 399/100

(Continued)

FOREIGN PATENT DOCUMENTS

CN 1881096 A 12/2006
CN 101376467 A 3/2009

(Continued)

OTHER PUBLICATIONS

Apr. 24, 2014 Notification of the First Office Action issued in Chinese Patent Application No. 201010503208.7 (with English translation).

(Continued)

*Primary Examiner* — Daniel J Colilla
*Assistant Examiner* — John M Royston
(74) *Attorney, Agent, or Firm* — Oliff PLC

(57) ABSTRACT

A medium conveying device includes an alignment member, a skew conveying member, and a removal member. The alignment member faces one end of a medium and aligns the medium while contacting with the medium when the medium is conveyed in a first direction. The skew conveying member conveys the medium in a second direction crossing to the first direction so that the one end comes in contact with the alignment member and that includes a drive member and a driven member opposed to the drive member and driven by the drive member. The removal member has a tip end coming in contact with a face of the drive member to remove a deposit on the face. The removal member is placed along a rotation direction of the drive member so that the tip end faces downstream of the rotational direction.

8 Claims, 10 Drawing Sheets

(51) Int. Cl.
*B65H 5/06* (2006.01)
*B65H 9/16* (2006.01)
*G03G 15/23* (2006.01)

(52) U.S. Cl.
CPC .... *G03G 15/235* (2013.01); *G03G 2215/00561* (2013.01); *G03G 2215/00679* (2013.01)

(56) References Cited

U.S. PATENT DOCUMENTS

| | | | | |
|---|---|---|---|---|
| 7,295,802 | B2 * | 11/2007 | Kabata et al. | 399/350 |
| 7,658,379 | B2 * | 2/2010 | Yasumoto | 271/251 |
| 2006/0197038 | A1 | 9/2006 | Park et al. | |
| 2007/0110488 | A1 | 5/2007 | Kabata et al. | |
| 2009/0057994 | A1 | 3/2009 | Kondo | |
| 2009/0091075 | A1 | 4/2009 | Yasumoto | |
| 2010/0067945 | A1 * | 3/2010 | Hozumi et al. | 399/111 |

FOREIGN PATENT DOCUMENTS

| | | | |
|---|---|---|---|
| JP | 05286598 | A * | 11/1993 |
| JP | A-6-161164 | | 6/1994 |
| JP | A-6-211374 | | 8/1994 |
| JP | A-07-025503 | | 1/1995 |
| JP | A-2000-313540 | | 11/2000 |
| JP | A-2005-112543 | | 4/2005 |
| JP | 2006182562 | A * | 7/2006 |
| JP | A-2006-182562 | | 7/2006 |
| JP | A-2007-161361 | | 6/2007 |

OTHER PUBLICATIONS

Nov. 12, 2013 Office Action issued in Japanese Patent Application No. 2009-282028 (with translation).

* cited by examiner

MEDIUM CONVEYING DEVICE WITH SKEW CONVEYING MEMBER CLEANER

CROSS-REFERENCE TO RELATED APPLICATIONS

This application is based upon and claims priority under 35 USC 119 from Japanese Patent Application No. 2009-282028, filed Dec. 11, 2009.

BACKGROUND

Technical Field

This invention relates to a medium conveying device and an image forming apparatus.

SUMMARY OF THE INVENTION

According to an aspect of the invention, a medium conveying device includes an alignment member, a skew conveying member, and a removal member. The alignment member faces one end of a medium and aligns the medium while contacting with the medium when the medium is conveyed in a first direction. The skew conveying member conveys the medium in a second direction crossing to the first direction so that the one end comes in contact with the alignment member and that includes a drive member and a driven member opposed to the drive member and driven by the drive member. The removal member has a tip end coming in contact with a face of the drive member to remove a deposit on the face. The removal member is placed along a rotation direction of the drive member so that the tip end faces downstream of the rotational direction.

BRIEF DESCRIPTION OF THE DRAWINGS

Exemplary embodiments of the invention will be described in detail based on the following figures, wherein.

DETAILED DESCRIPTION

Figure 1:
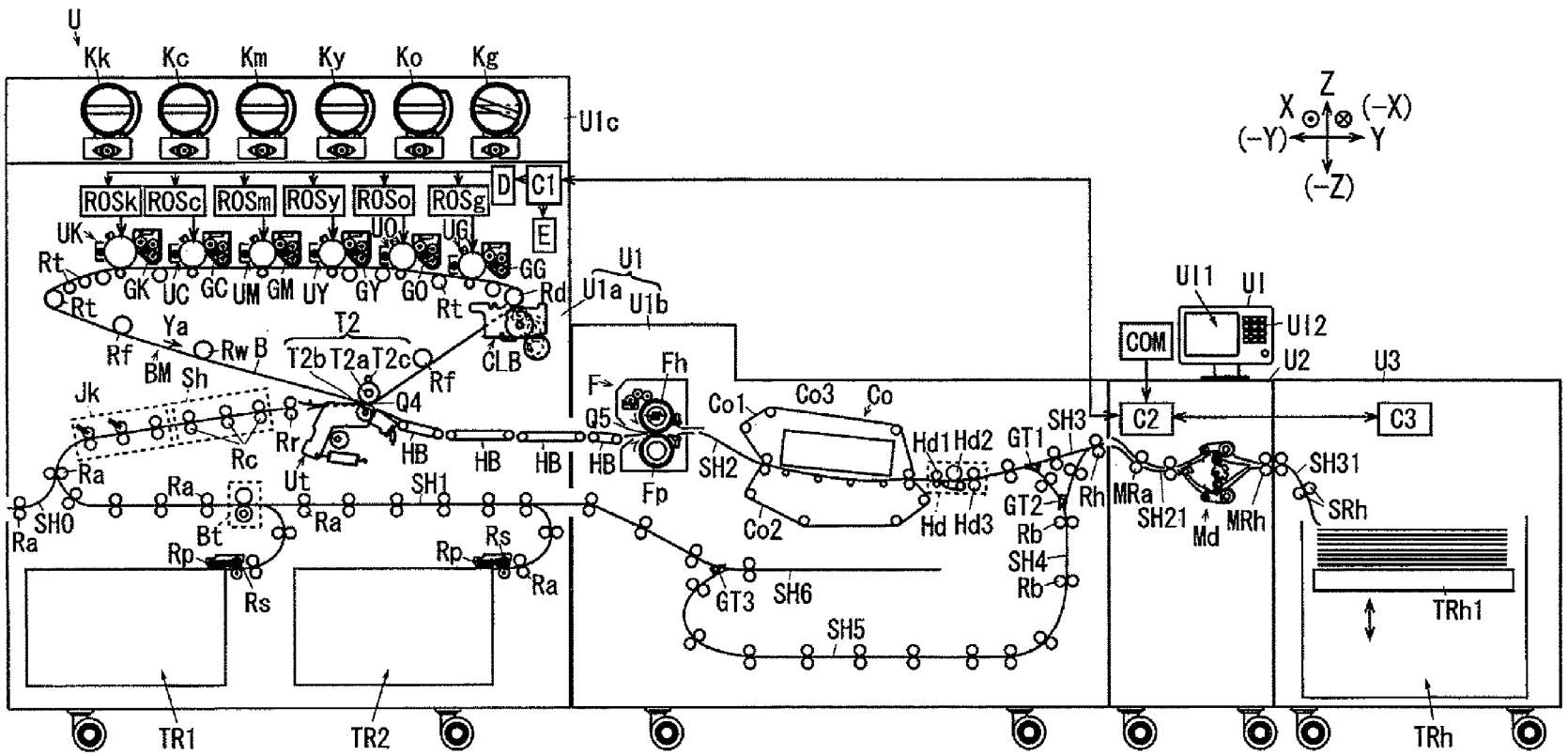
FIG. 1 is a general schematic representation of a printer of Exemplary Embodiment 1 of the invention.

Exemplary embodiments as specific examples of the mode for carrying out the invention will be discussed with reference to the accompanying drawings. However, the invention is not limited to the following exemplary embodiments.

For easy understanding of the description to follow, in the accompanying drawings, back and forth direction is X axis direction, side to side direction (left-right direction) is Y axis direction, and up and down direction is Z axis direction, and directions or sides indicated by arrows X, −X, Y, −Y, Z, and −Z are forward, backward, rightward, leftward, upward, and downward or front, rear (back), right, left, upper side (top), and lower side (bottom).

In the accompanying drawings, a mark including a dot described in a circle means an arrow from the back of the plane of the drawing to the surface and a mark including X described in a circle means an arrow from the surface of the plane of the drawing to the back.

In the description that follows using the accompanying drawings, members other than the members required for the description are not shown in the drawings where appropriate for easy understanding of the description.

[Exemplary Embodiment 1]

(Description of printer U of Exemplary Embodiment 1)

FIG. 1 is a general schematic representation of a printer of Exemplary Embodiment 1 of the invention.

Figure 2:
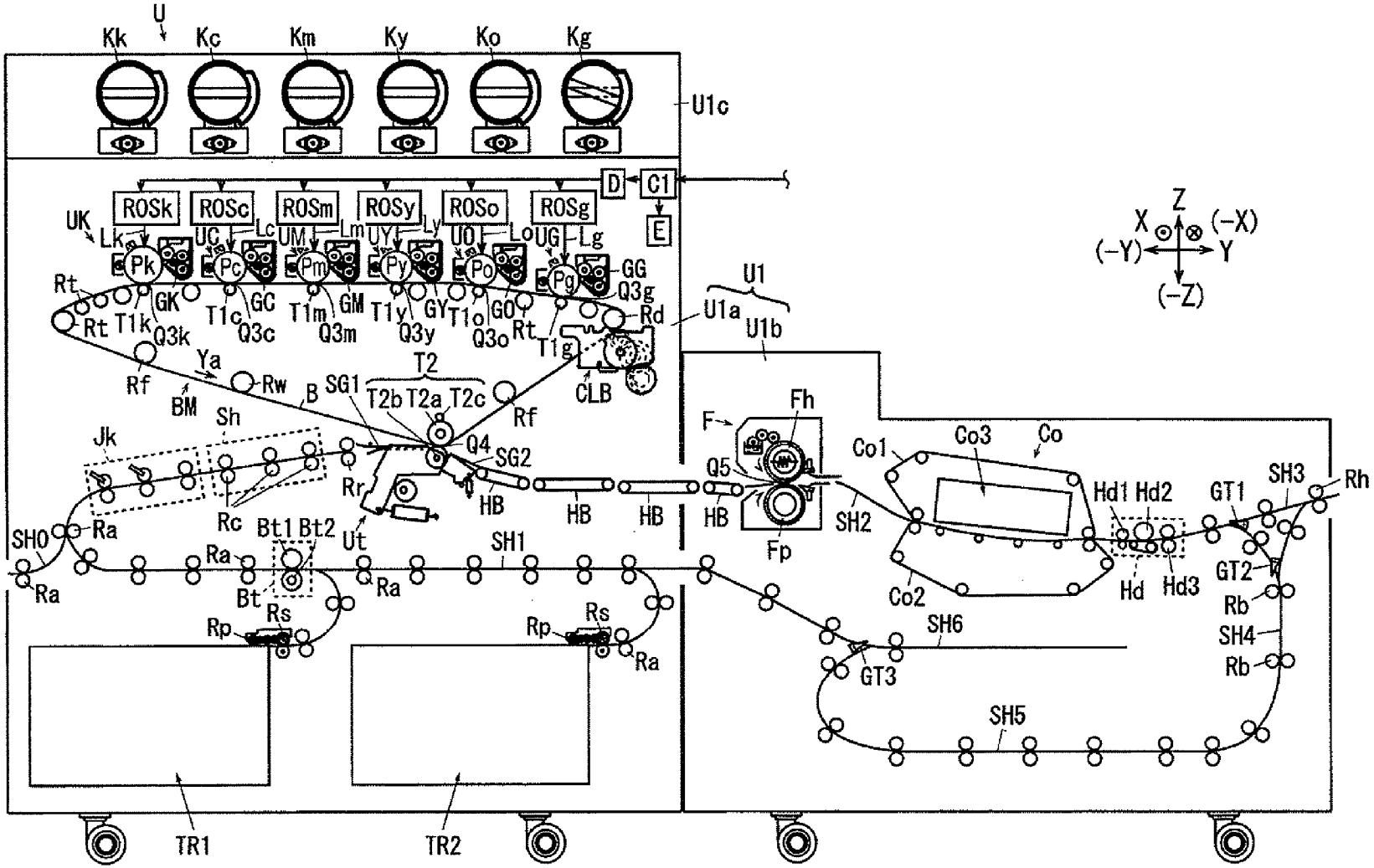
FIG. 2 is a schematic representation of an image forming apparatus main body of the printer of Exemplary Embodiment 1 of the invention.

FIG. 2 is a schematic representation of an image forming apparatus main body of the printer of Exemplary Embodiment 1 of the invention.

Figure 3:
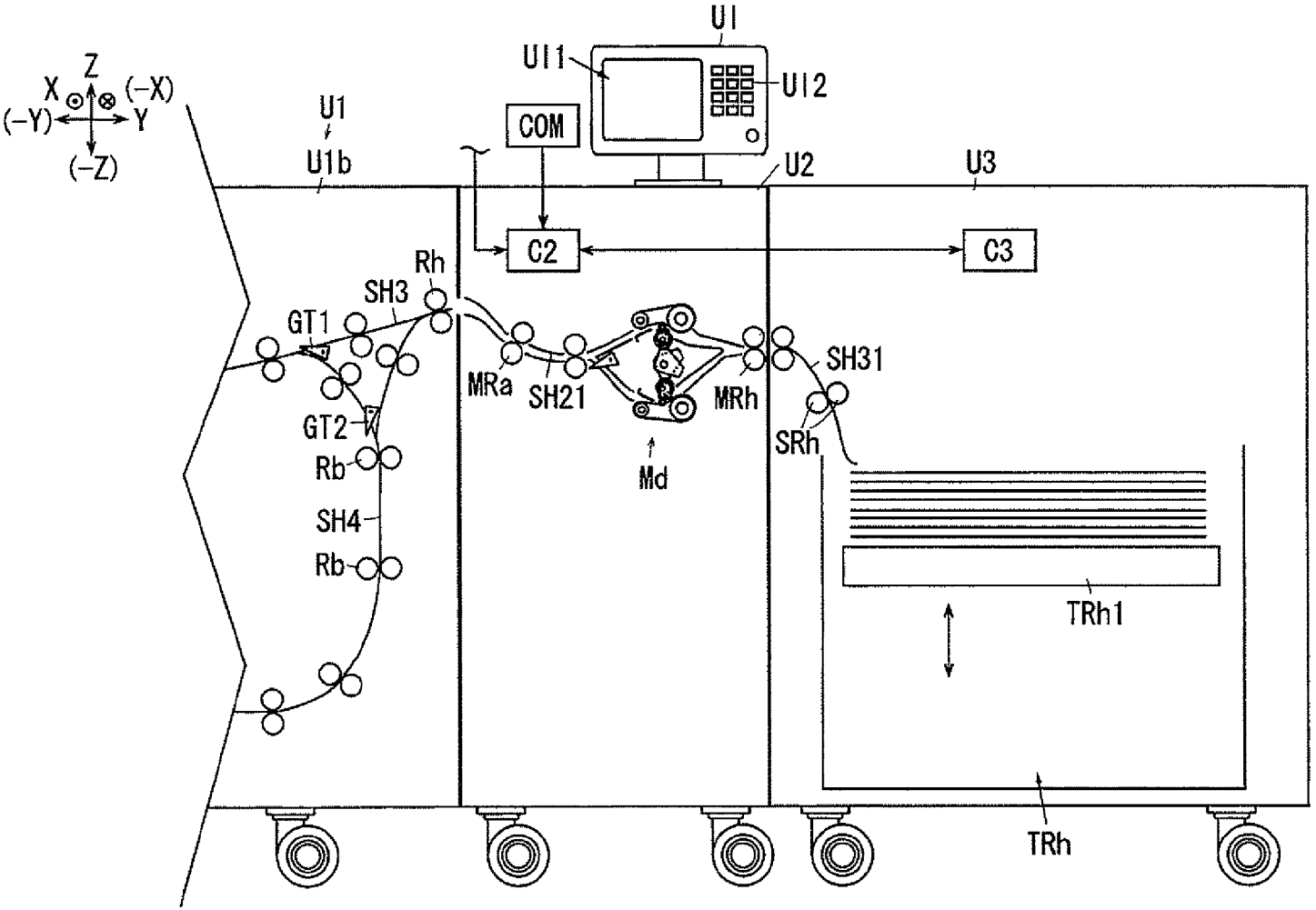
FIG. 3 is a schematic representation of an interface module and a stacker device of the printer of Exemplary Embodiment 1 of the invention.

FIG. 3 is a schematic representation of an interface module and a stacker device of the printer of Exemplary Embodiment 1 of the invention.

In FIGS. 1 to 3, a printer U as an example of an image forming apparatus has an image forming apparatus main body U1 as an example of an image record section, an interface module U2 placed downstream in a medium discharge direction of the image forming apparatus main body U1 and having an operation section UI for operating the printer U as an example of a bend removal section, and a stacker device U3 placed downstream in a medium discharge direction of the interface module U2 as an example of a medium discharge stack device.

(Description of Image Forming Apparatus Main Body U1 of Exemplary Embodiment 1)

In FIG. 2, the image forming apparatus main body U1 has a record section main body U1*a*, a fix inversion section U1*b*, a main body side control section C1 for controlling the image forming apparatus main body U1, an information transmission and reception device (not shown) for receiving image information transmitted through the interface module U2 from an external information transmission device COM, and a latent image forming device drive circuit D, a power supply circuit E, etc., controlled by the main body side control section C1.

The latent image forming device drive circuit D of the record section main body U1*a* controlled by the main body side control section C1 creates image information of G: Green, O: Orange, Y: Yellow, M: Magenta, C: Cyan, and K: Black based on image information transmitted through the interface module U2 and outputs drive signals responsive to the image information to latent image forming devices ROSg, ROSo, ROSy, ROSm, ROSc, and ROSk of the colors G to K at preset timings.

Figure 4:
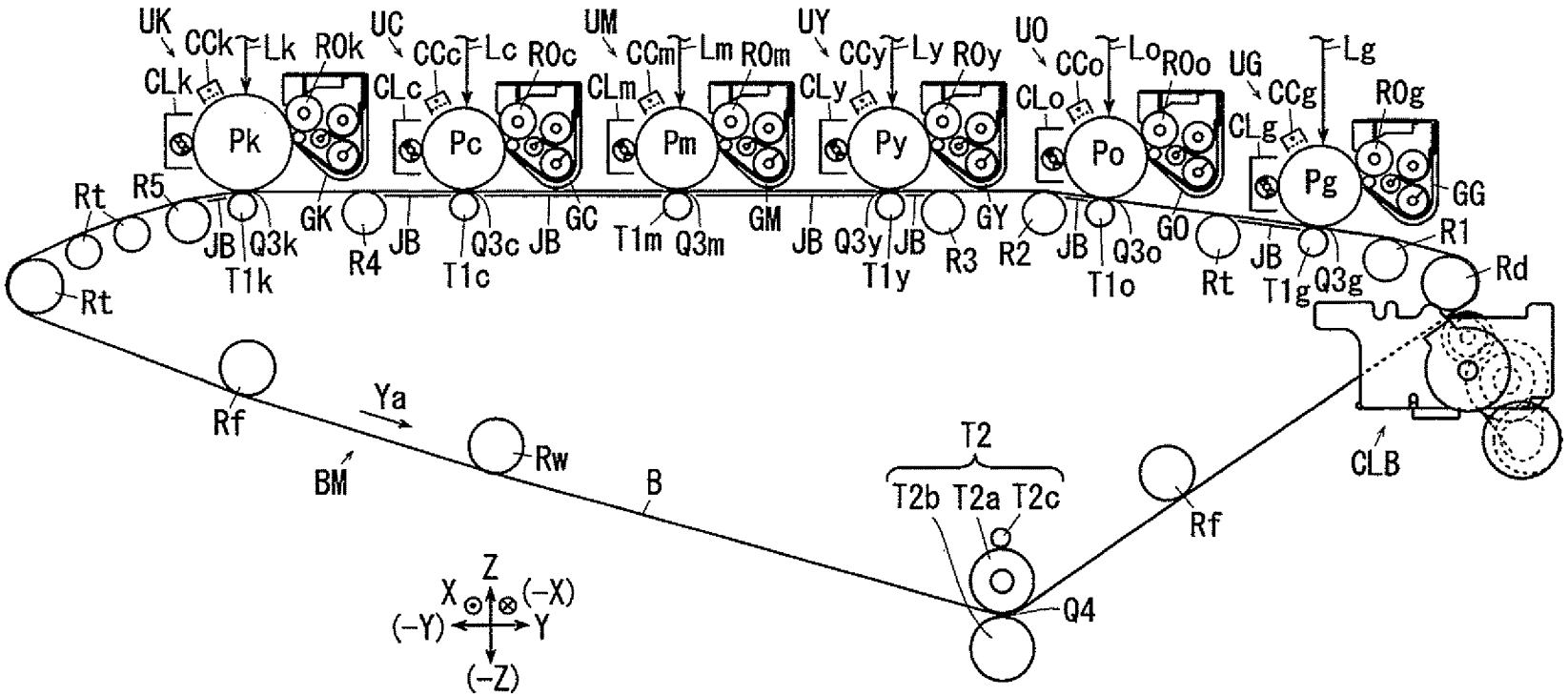
FIG. 4 is a main part enlarged schematic representation of the image forming apparatus main body and is a schematic representation of visible image forming devices and a belt module.

FIG. 4 is a main part enlarged schematic representation of the image forming apparatus main body and is a schematic representation of visible image forming devices and a belt module.

In FIGS. 2 and 4, image holding units UG, UO, UY, UM, UC, and UK of colors G to K and developing devices GG, GO, GY, GM, GC, and GK of colors G to K as an example of developing device are detachably placed below latent image forming devices ROSg to ROSk of colors G to K.

The image holding unit UK of black K has a photoconductive drum Pk as an example of an image holding body, a charger CCk, and a drum cleaner CLk as an example of an image holding body cleaner. A developing roll ROk as an example of a developing member of the developing device GK of black K is placed adjacent to the right of the photoconductive drum Pk.

The image holding units UG, UO, UY, UM, and UC of other colors G to C also have photoconductive drums Pg, Po, Py, Pm, and Pc, chargers CCg, CCo, CCy, CCm, and CCc, and drum cleaners CLg, CLo, CLy, CLm, and CLc respectively. Developing rolls ROg, ROo, ROy, ROm, and ROc as examples of developing members of the developing devices GG to GC of other colors G to C are placed adjacent to the right of the photoconductive drums Pg to Pc of other colors G to C respectively.

In Exemplary Embodiment 1, the photoconductive drum Pk of color K frequently used with much surface wear has a large diameter as compared with other color photoconductive drums Pg to Pc for high-speed rotation and a longer life.

The image holding units UG to UK and the developing devices GG to GK make up visible image forming devices (UG+GG), (UO+GO), (UY+GY), (UM+GM), (UC+GC), and (UK+GK).

In FIGS. 2 and 4, the photoconductive drums Pg to Pk are uniformly charged by the chargers CCg to CCk respectively and then electrostatic latent images are formed on surfaces by laser beams Lg, Lo, Ly, Lm, Lc, and Lk as an example of latent image write light output by the latent image forming devices ROSg to ROSk. The electrostatic latent images on the surfaces of the photoconductive drums Pg to Pk are developed to toner images as example of visible image of G: Green, O: Orange, Y: Yellow, M: Magenta, C: Cyan, and K: Black by developers in the developing devices GG to GK.

When the developers in the developing devices GG to GK are consumed by developing, the developing devices GG to GK are replenished with developers from a developer replenishing device U1*c* provided in an upper part of the image forming apparatus main body U1. Toner cartridges Kg, Ko, Ky, Km, Kc, and Kk each as an example of a developer replenishing vessel are detachably and replaceably supported in the developer replenishing device U1*c*.

In FIGS. 2 and 4, the toner images on the surfaces of the photoconductive drums Pg to Pk are transferred in an overlap manner in order onto an intermediate transfer belt B as an example of an intermediate transfer body by primary transfer rolls T1*g*, T1*o*, T1*y*, T1*m*, T1*c*, and T1*k* each as an example of a primary transfer member in primary transfer areas Q3*g*, Q3*o*, Q3*y*, Q3*m*, Q3*c*, and Q3*k* and a multiple color image, a so-called color image is formed on the intermediate transfer belt B. The color image formed on the intermediate transfer belt B is conveyed to a secondary transfer area Q4.

If black image data only exists, only the photoconductive drum Pk of black K and the developing device GK are used and only a toner image of black K is formed. If four-color print of Y, M, C, and K or two-color, three-color print, etc., responsive to setting of the user is executed, the corresponding photoconductive drums Pg to Pk and the corresponding developing devices GG to GK are used.

After the primary transfer, the remaining toner on the surfaces of the photoconductive drums Pg to Pk is cleaned by drum cleaners CLg to CLk for the photoconductive drums and the photoconductive drums are again charged by the chargers CCg to CCk.

In FIGS. 1, 2, and 4, a belt module BM as an example of an intermediate transfer device is supported so that it may move up and down between an up position coming in contact with the lower faces of the photoconductive drums Pg to Pk and a down position downward away from the lower faces below the photoconductive drums Pg to Pk.

The belt module BM has an intermediate transfer belt B. This intermediate transfer belt B is rotated in an arrow Ya direction by a belt drive roll Rd as an example of an intermediate transfer body drive member for supporting the intermediate transfer belt B from the back and is given tension by a tension roll Rt as an example of a tension giving member and is stretched. The back side of the intermediate transfer belt B is supported by a walking roll Rw as an example of a meander prevention member for preventing the intermediate transfer belt B from meandering, a plurality of idler rolls Rf each as an example of a driven member, and a backup roll T2*a* as an example of a secondary transfer opposed member.

In FIG. 4, in Exemplary Embodiment, a first retract roll R1 as an example of a contact/out of contact intermediate transfer body support member supported movably in a contact and out of contact direction, the direction perpendicular to the arrow Ya direction and the direction for bringing the intermediate transfer belt B into and out of contact with the photoconductive drum Pg is placed upstream in the arrow Ya direction of the primary transfer roll T1*g* of G color. A second retract roll R2 and a third retract roll R3 each as an example of the contact/out of contact intermediate transfer body support member configured like the first retract roll R1 are placed side by side downstream in the arrow Ya direction of each primary transfer roll T1*o* of O color and upstream in the arrow Ya direction of each primary transfer roll T1*y* of Y color. A fourth retract roll R4 as an example of the contact/out of contact intermediate transfer body support member configured like the first retract roll R1 is placed downstream in the arrow Ya direction of each primary transfer roll T1*c* of C color and upstream in the arrow Ya direction of each primary transfer roll T1*k* of K color. Further, a fifth retract roll R5 as an example of the contact/out of contact intermediate transfer body support member configured like the first retract roll R1 is placed downstream in the arrow Ya direction of each primary transfer roll T1*k* of K color. and upstream in the arrow Ya direction of each primary transfer roll T1*k* of K color.

In FIG. 4, a flat static elimination metal sheet JB as an example of a static elimination member for removing charge on the back of the intermediate transfer belt B is placed downstream in the arrow Ya direction of the primary transfer rolls T1*g* to T1*k*. The static elimination metal sheet JB of Exemplary Embodiment 1 is placed out of contact with the intermediate transfer belt B; for example, it may be placed at a 2-mm distance from the back of the intermediate transfer belt B.

The rolls Rd, Rt, Rw, Rf, T2*a*, and R1-R5 form belt support rolls Rd, Rt, Rw, Rf, T2*a*, and R1-R5 as an example of an intermediate transfer body support member for supporting the intermediate transfer belt B for rotation from the back.

The intermediate transfer belt B, the belt support rolls Rd, Rt, Rw, Rf, T2*a*, and R1-R5, the primary transfer rolls T1*g* to T1*k*, the static elimination metal sheet JB, and the like make up the belt module BM of Exemplary Embodiment 1.

A secondary transfer unit Ut is placed below the backup roll T2*a*. The secondary transfer unit Ut is provided with a secondary transfer roll T2*b* as an example of a secondary transfer member. The secondary transfer roll T2*b* is placed so that it may come in contact with and out of contact with the backup roll T2*a* across the intermediate transfer belt B. An area where the secondary transfer roll T2*b* is in press-contact with the intermediate transfer belt B forms a secondary transfer area Q4. A contract roll T2*c* as an example of a contact conduction member abuts the backup roll T2*a*. A secondary transfer voltage of the same polarity as the charge polarity of a developer is applied to the contract roll T2*c* at a preset timing from the power supply circuit B controlled by the main body side control section C1.

The backup roll T2*a*, the secondary transfer roll T2*b*, and the contract roll T2*c* make up a secondary transfer device T2 of Exemplary Embodiment 1. The primary transfer rolls T1*g* to T1*k*, the intermediate transfer belt B, and the secondary transfer device T2 make up transfer device T1*g* to T1*k*+T2+B of Exemplary Embodiment 1.

Sheet feed trays TR1 and TR2 each as an example of medium storage section in which a record sheet S as an example of a medium is stored are provided below the belt module BM. A record sheet S stored in the sheet feed tray TR1, TR2 is taken out from the sheet feed tray TR1, TR2 by a pickup roll Rp as a medium taking out member and is separated as one sheet at a time by a separation roll Rs as an example of a separation member and is conveyed to a medium supply passage SH1 extending to a registration roll Rr.

The record sheet S conveyed to the medium supply passage SH1 is conveyed to a deburr device Bt as an example of a medium unnecessary part removal device by a conveying roll Ra as an example of a medium conveying member. The deburr device Bt has a press roll Bt1 as an example of a press member and an opposed roll Bt2 pressed against the press roll Bt1 and coming in contact therewith as an example of an opposed member. The record sheet S is pressed, sandwiched, and conveyed by the press roll Bt1 and the opposed roll Bt2 and an unnecessary part of a record sheet S end part is removed, namely, the record sheet S is deburred.

The deburred record sheet S is conveyed to an overlap convey detector Jk. The overlap convey detector Jk detects whether or not record sheets cannot be separated as one sheet at a time by the separation roll Rs and more than one record sheet S is conveyed in an overlap manner (overlap covey).

A manual supply passage SH0 is connected upstream in the medium conveying direction of the overlap convey detector Jk and overlap convey of a record sheet S supplied from a manual medium supply section (not shown) is also detected by the overlap convey detector Jk.

The record sheet S as to whether or not it is overlap convey is detected is conveyed to a skew correction device Sh as an example of a medium conveying device and an example of an attitude correction device. The skew correction device Sh has a crossed roll Rc as an example of a skew conveying member and brings a side margin of the record sheet S into contact with a side guide described later by the crossed roll Rc for correcting inclined attitude of the record sheet S, so-called skew.

The record sheet S whose skew is corrected is conveyed to the registration roll Rr as an example of a conveying timing adjustment member.

The record sheet S conveyed to the registration roll Rr is conveyed through a before-transfer medium guide member SG1 to the secondary transfer area Q4 at the timing at which the multiple color image or single color image on the intermediate transfer belt B is conveyed to the secondary transfer area Q4.

When the multiple color image on the intermediate transfer belt B passes through the secondary transfer area Q4, the image is transferred to the record sheet S by the secondary transfer device. For the multiple color image, toner images primarily transferred to the surface of the intermediate transfer belt B in an overlap manner are secondarily transferred to the record sheet S collectively. The intermediate transfer belt B after the secondary transfer is cleaned by a belt cleaner CLB as an example of an intermediate transfer body cleaner.

In FIGS. 1 to 3, the record sheet S to which an unfixed visible image is secondarily transferred is conveyed through an after-transfer medium guide member SG2 to a fixing device F provided in the fix inversion section U1*b* by a conveying belt HB as an example of a before-fix medium conveying member.

In FIG. 2, the fixing device F has a heating roll Fh as an example of heat fixing member and a press roll Fp as an example of a press fix member. The record sheet S is conveyed to a fix area Q5 where a pair of fix members Fh and Fp comes in contact in a state in which pressure acts. The unfixed visible image on the record sheet S is heated and fixed by the fixing device F when it passes through the fix area Q5.

In FIG. 2, the heated and fixed record sheet S is conveyed to a cooling device Co. The cooling device Co has an upper conveying belt Co1 stretched for rotation as an example of an upper conveying member shaped like an endless belt and a lower conveying belt Co2 opposed to the upper conveying belt Co1 and stretched for rotation as an example of a lower conveying member shaped like an endless belt. A heat sink Co3 as an example a radiation member is placed inside the upper conveying belt Co1 and heat of the upper conveying belt Co1 is taken away and is discharged to the outside by a wind sending member (not shown).

Accordingly, when the record sheet S heated by the fixing device F is sandwiched between the paired conveying belts Co1 and Co2 and is conveyed, heat of the record sheet S is taken away by the conveying belts Co1 and Co2 and the record sheet S is cooled.

The cooled record sheet S is conveyed to a main body decurl device Hd as an example of a bend removal device on the main body side. The main body decurl device Hd has a roll-type decurl member Hd1 for sandwiching the record sheet between an upper soft cylindrical member having a large diameter and a lower hard cylindrical member having a small diameter and removing bend of the record sheet, so-called curl as an example of a first bend removal member. A belt-type decurl member Hd2 for sandwiching the record sheet between a stretched endless belt member and a cylindrical member for coming in contact with the endless belt member from above and removing curl as an example of a second bend removal member is placed downstream in the medium conveying direction of the roll-type decurl member Hd1.

In the main body decurl device Hd, the curl of the record sheet is removed by the roll-type decurl member Hd1 and the belt-type decurl member Hd2 and then the record sheet is discharged from the main body decurl device Hd by a discharge member Hd3.

A conveying passage switch member GT1 is provided downstream in the medium conveying direction of the main body decurl device Hd. The conveying passage switch member GT1 selectively switches the conveying destination of the record sheet S conveyed through a main body processing passage SH2 as an example of a medium conveying passage to either a main body discharge passage SH3 or a medium inversion passage SH4.

The record sheet S conveyed to the main body discharge passage SH3 is conveyed to the interface module U2 with the image record face up, in so-called face up state by a main body discharge roll Rh as an example of a main body discharge member.

To convey the record sheet S to the interface module U2 with the image record face inverted to a down state from an up state, in so-called face down state, the record sheet S conveyed from the main body processing passage SH2 is guided to the medium inversion passage SH4 by the conveying passage switch member GT1. When the trailing end of the record sheet S in the medium conveying direction passes through a conveying passage switch member GT2 provided at the branch part of the medium inversion passage SH4, the record sheet S is inversely conveyed, namely, is switched back by an inversion roll Rb that may rotate forward and backward as an example of an inversion conveying member. The switch-backed record sheet S is guided to the main body discharge passage SH3 by the conveying passage switch member GT2 and the image record face of the record sheet S is inverted to the face down state from the face up state and the record sheet S is conveyed to the interface module U2.

To record an image on both sides of the record sheet S, the record sheet S with an image already recorded on one side conveyed from the main body processing passage SH2 is guided to the medium inversion passage SH4 by the conveying passage switch member GT1. The record sheet S is conveyed to a medium circulation passage SH5 by the inversion roll Rb in the medium inversion passage SH4 and is conveyed toward a double-side record inversion passage SH6. When the trailing end of the record sheet S in the medium conveying direction passes through a conveying passage switch member GT3 provided in a connection part of the medium circulation passage SH5 and the double-side record inversion passage SH6, the record sheet S is switched back. The switched-back record sheet S is guided to the medium supply passage SH1 side by the conveying passage switch member GT3 and is again sent to the medium supply passage SH1.

The record sheet S with an image recorded on one side is conveyed through the medium supply passage SH1 in a surface and back inversion state and is again sent to the secondary transfer area Q4 and an image is recorded on the other side where no image is recorded.

(Description of Interface Module U2 of Exemplary Embodiment 1)

In FIG. 3, the operation section UI of the interface module U2 has a display section UI1 for displaying information and input buttons UI2 for making various settings of the printer U. The interface module U2 has a main control section C2 for receiving image information from the external information transmission device COM and controlling various types of processing and the printer U.

A curl removal passage SH21 as an example of a conveying passage of a bend removing device is provided in the interface module U2. The record sheet S is conveyed to the curl removal passage SH21 from the main body discharge passage SH3 of the image forming apparatus main body U1. The record sheet S conveyed to the curl removal passage SH21 is conveyed to a module decurl device Md as an example of a bend removing device main body by a conveying roll MRa. Curl of the record sheet S is removed by the module decurl device Md and the record sheet S is discharged from the curl removal passage SH21 to the stacker device U3 by a discharge roll MRh. The module decurl device Md is already known and may adopt a similar configuration to that described in Japanese Patent Laid Open. No. 2006-520333 and therefore will not be discussed again in detail.

(Description of Stacker Device U3 of Exemplary Embodiment 1)

In FIG. 3, the stacker device U3 of Exemplary Embodiment 1 has a stacker discharge passage SH31 connected to the curl removal passage SH21 of the interface module U2 as an example of a conveying passage of the medium discharge stack device. A stacker discharge roll SRh as an example of a medium discharge number of the medium discharge stack device is placed downstream in the medium conveying direction of the stacker discharge passage SH31. The record sheet S is discharged to and is stacked in a stacker vessel TRh as an example of a stack example placed in a lower part by the stacker discharge roll SRh. A bottom plate TRh1 on which the record sheet is stacked as an example of a stack member is placed in the stacker vessel TRh. The bottom plate TRh1 is automatically moved up and down in response to the stack amount of the record sheets S.

(Description of Medium Conveying Device)

Figure 5:
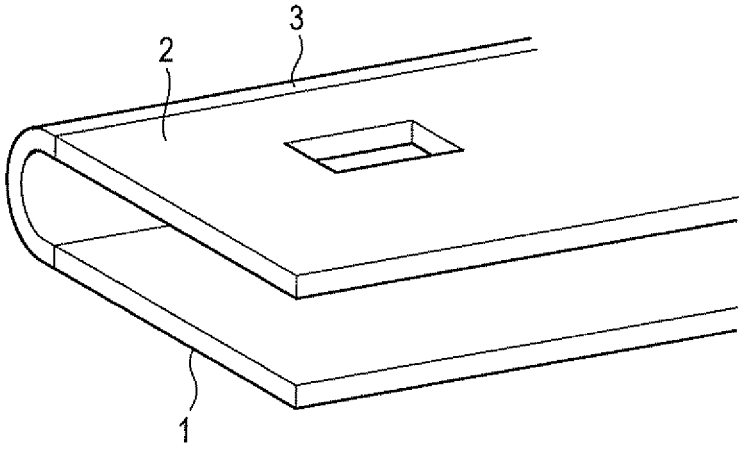
FIG. 5 is an enlarged drawing of a part of a skew correction device of Exemplary Embodiment 1.

FIG. 5 is an enlarged drawing of an upper sheet guide 2, a lower sheet guide 1, and a side guide 3 in the skew correction device of Exemplary Embodiment 1.

Figure 6:
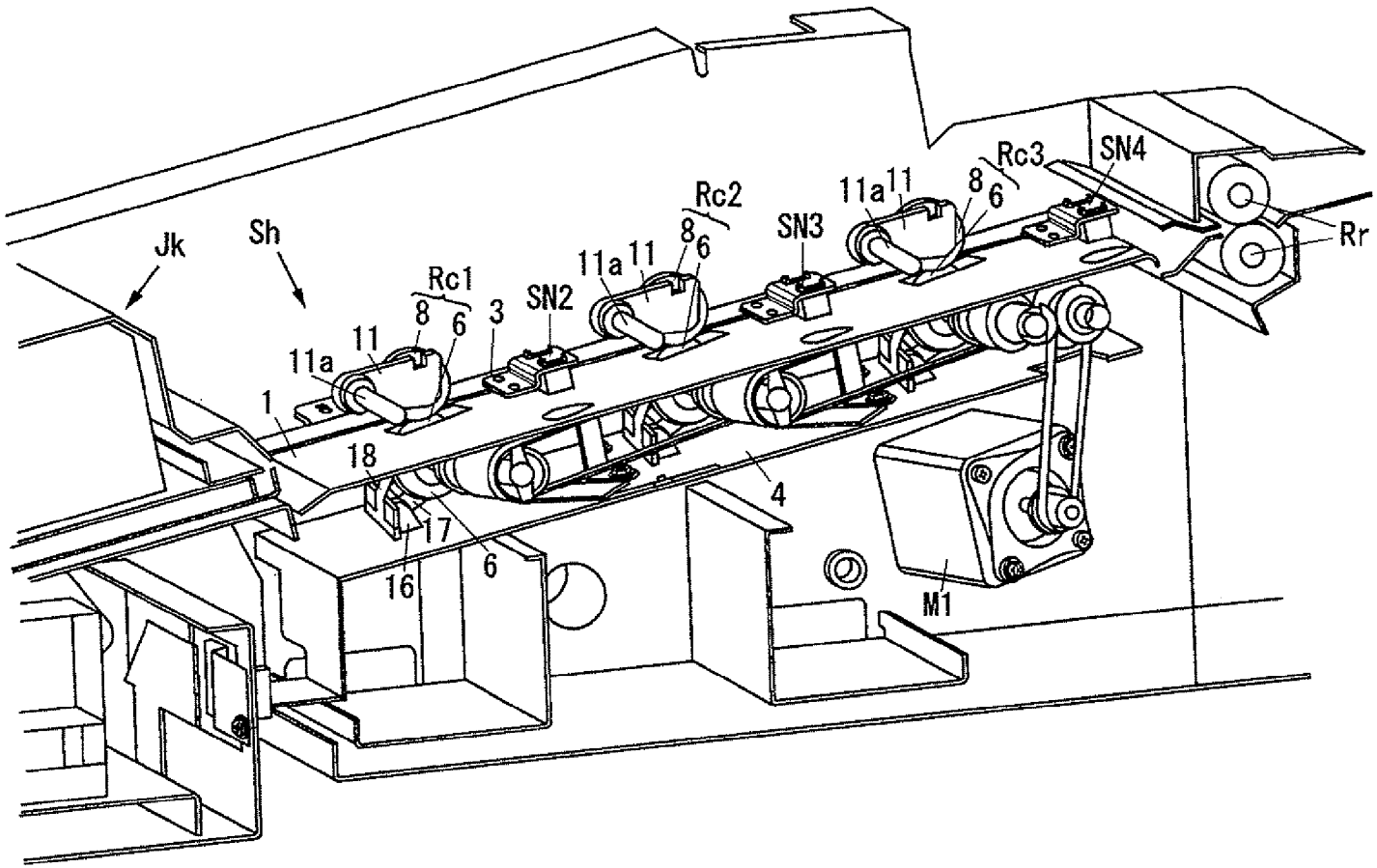
FIG. 6 is a main part sectional schematic representation of the skew correction device of Exemplary Embodiment 1.

FIG. 6 is a main part sectional schematic representation of the skew correction device of Exemplary Embodiment 1.

In FIG. 6, for easy understanding, a part of members for the description are not shown as required. For example, in FIG. 6, the upper sheet guide is not shown.

In FIGS. 1, 2, and 6, the skew correction device Sh as an example of the medium conveying device of Exemplary Embodiment 1 has a pair of upper and lower plate-shaped sheet guides 2 and 1 forming the medium supply passage SH1 as an example of medium guide member. The side guide 3 extending in the up and down direction as an example of a side end alignment member is placed in the rear end parts of the sheet guides 1 and 2.

A drive support plate 4 extending in parallel to the sheet guide 1 as an example of a drive member support is supported on the lower side of the lower sheet guide 1. Drive rollers 6 as an example of drive members of three crossed rolls Rc1, Rc2, and Rc3 are placed between the drive support plate 4 and the sheet guide 1. The drive rollers 6 of Exemplary Embodiment 1 are inclined toward the rear side guide 3 relative to the medium conveying direction and rotate in the conveying direction toward the side guide 3 while conveying downstream in the conveying direction.

Drive to the drive rollers 6 is transmitted as a crossed motor M1 as an example of a drive source. In Exemplary Embodiment 1, a motor rotating at an angle responsive to the number of input rectangular waves, a motor called a pulse motor or a stepping motor, is used. Drive is transmitted from the crossed motor M1 to the drive motors 6 through a plurality of belts 7.

Three driven rolls 8 opposed to the drive rollers 6 as an example of driven members are placed on the upper side of the upper sheet guide 2. Each of the driven rollers 8 is rotatably supported on a moving up and down arm 11 as an example of a moving up and down member, and the moving up and down arms 11 are rotatably supported on the upper sheet guide 2 with a rotation shaft 11*a* as the center. Each of the moving up and down arms 11 is driven by a moving up and down motor as an example of a moving up and down drive source (not shown) and may move between a moving down position at which the driven roller 8 comes in contact with the drive roller 6 and a moving up position at which the driven roller 8 is brought away from the drive roller 6.

A first crossed sensor SN1, a second crossed sensor SN2, and a third crossed sensor SN3 for detecting the record sheet S each as an example of a medium detection member are placed in the proximity of the upstream side of the first, second, and third crossed rolls Rc1, Rc2, and Rc3 in order from the upstream side. A registration in sensor SN4 as an example of a medium detection member is placed between the downstream third crossed roller Rc3 and the registration roll Rr.

(Description of Removal Member and Upstream Removal Member)

Figure 7A:
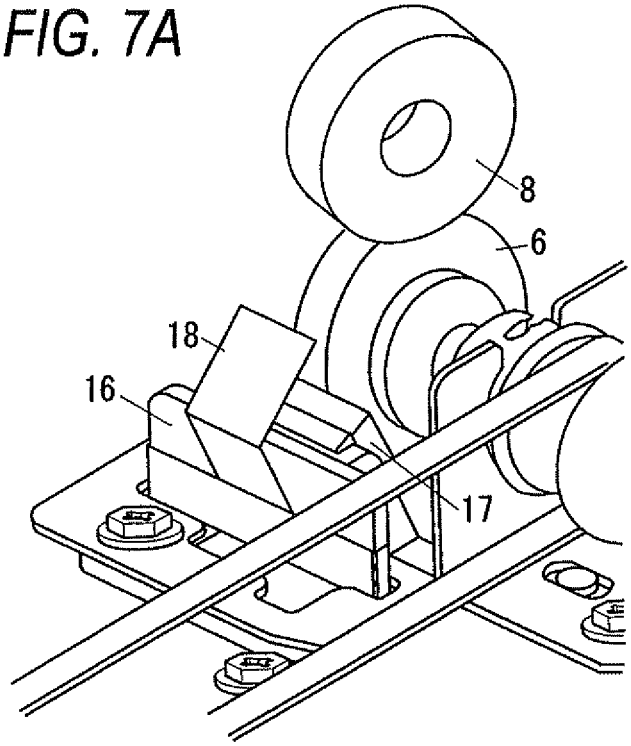
FIG. 7A is a perspective view of a crossed cleaner.
Figure 7B:
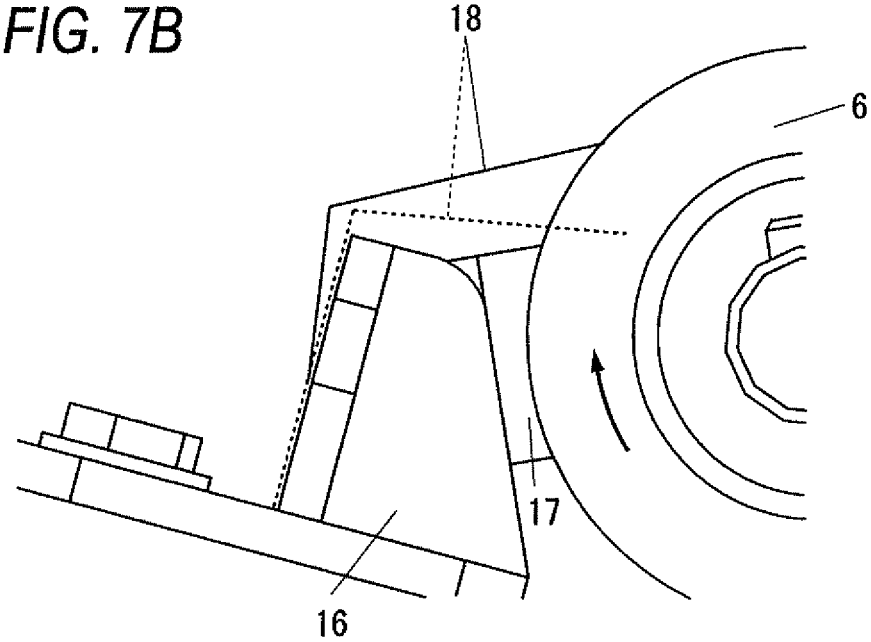
FIG. 7B is a side view of the crossed cleaner.

FIG. 7A is a perspective view and FIG. 7B is a side view.

In FIGS. 6 to 7B, a cleaner support part 16 supported on the drive support plate 4 as an example of a removal support is supported upstream in the conveying direction of each drive roll 6. A paper dust removal pad 17 as an example of an upstream removal member is supported on a face of the cleaner support part 16 opposed to the drive roll 6. The paper dust removal pad 17, which is formed of felt as an example of an elastic member, comes in contact with the surface of the drive roll 6 at preset contact pressure and removes a deposit with a comparatively weak deposition force such as paper dust deposited on the drive roll 6. The paper dust removal pad 17 is not limited to felt and any material capable of removing paper dust, such as a sponge as an example of a foam member may be used.

In FIGS. 6 to 7B, a crossed cleaning blade 18 as an example of a removal member for coming in contact with the drive roll 6 is supported on the cleaner support part 16 downstream with respect to the rotation direction of the drive roll 6 of the paper dust removal pad 17. The crossed cleaning blade 18 is formed of a plate body shaped like a plate spring as an example of an elastic member and removes a deposit with a larger deposition force than that of paper dust, such as a developer fixed to the drive roll 6. For example, stainless steel, SUS (Stainless Used Steel), etc., may be used for the crossed cleaning blade 18. The material of the crossed cleaning blade 18 is not limited to a metal such as stainless steel and any desired material capable of removing a fixed developer may be used.

While the driver roll 6 does not exist, the crossed cleaning blade 18 crosses a position where the driver roll is placed when the driver roll exists. In a state in which the crossed cleaning blade 18 is in contact with the drive roll 6, the crossed cleaning blade 18 becomes elastically deformed and is placed in a direction in which the tip is along the downstream side of the rotation direction of the drive roll 6, so-called wiper direction or with direction as indicated by the solid line in FIG. 7B and comes in contact with the drive roll 6 at a preset contact pressure. In Exemplary Embodiment 1, the angle between the tangential direction of the drive roll 6 and the crossed cleaning blade 18 is set to 15° to 45° in a state in which the crossed cleaning blade 18 is in contact with the surface of the drive roll 6 indicated by the solid line in FIG. 7B. If the angle is smaller than 15°, there is a problem in that the contact pressure of the crossed cleaning blade 18 with the drive roll 6 is easily insufficient and setting at the assembling time is hard to perform. On the other hand, if the angle is larger than 45°, there is a problem in that at the rotating time, the crossed cleaning blade 18 is pushed by the drive roll 6 and easily jumps or is turned up and variation easily occurs in contact.

(Description of Control Section C)

Figure 8:
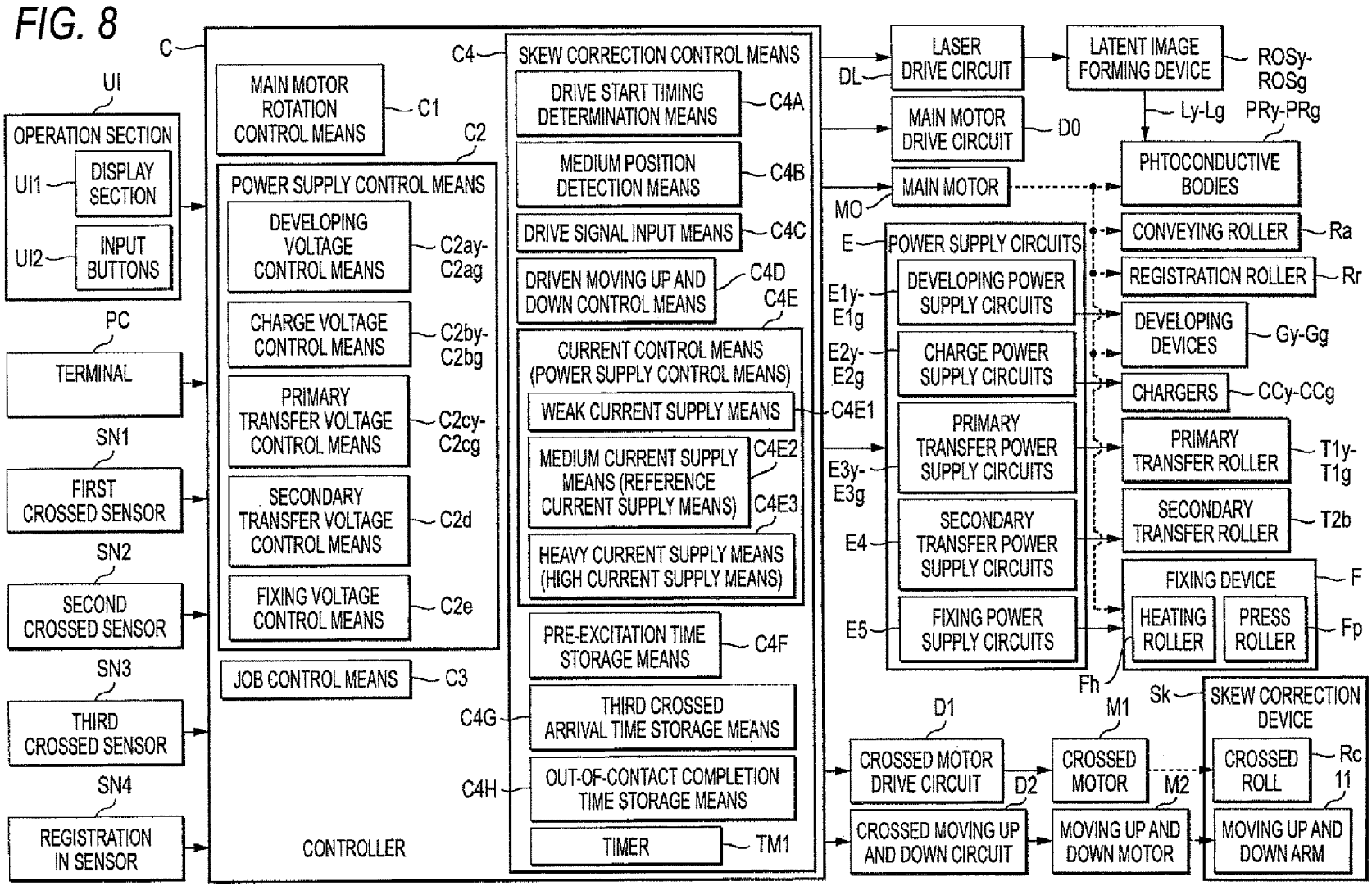
FIG. 8 is a main part schematic representation of a control section of Exemplary Embodiment 1.

FIG. 8 is a main part schematic representation of a control section of Exemplary Embodiment 1.

In FIG. 8, a control section C is made up of an input/output interface (I/O) for inputting and outputting a signal from and to the outside, adjusting the input/output signal level, etc., read-only memory (ROM) storing a program, information, etc., for performing required processing, random access memory (RAM) for temporarily storing necessary data, a central processing unit (CPU) for performing processing responsive to the program stored in the ROM, and a microcomputer having an oscillator, etc., and may implement various functions by executing the program stored in the ROM.

(Signal Input Elements Connected to Control Section C)

Output signals of the following U1, SN1 to SN4, etc., are input to the control section C.

UI: Operation Section

The operation section UI includes the display section U11, the input buttons UI2, etc.

SN1: First Crossed Sensor

The first crossed sensor SN1 detects whether or not the record sheet S enters the upstream side of the upstream first crossed roll Rc1.

SN2: Second Crossed Sensor

The second crossed sensor SN2 detects whether or not the record sheet S enters the upstream side of the second crossed roll Rc2 in the center of the conveying direction.

SN3: Third Crossed Sensor

The third crossed sensor SN3 detects whether or not the record sheet S enters the upstream side of the downstream third crossed roll Rc3.

SN4: Registration in Sensor

The registration in sensor SN4 detects whether or not the record sheet S enters the upstream side of the registration roll Rr.

(Controlled Elements Connected to Control Section C)

The control section C outputs control signals of the following controlled elements:

DL: Laser drive circuit

The laser drive circuit DL drives the latent image forming devices ROSy to ROSg and forms electrostatic latent images on the surfaces of photoconductive bodies PRy to PRg.

D0: Main motor drive circuit

The main motor drive circuit D0 as an example of a main drive source drive circuit drives a main motor M0, thereby the photoconductive bodies PRy to PRg and developing rollers of the developing devices Gy to Gg, the heating roller Ph, the conveying roll Ra, the registration roll Rr, etc., (not shown).

E: Power Supply Circuit

The power supply circuit E has the following power supply circuits:

E1*y* to E1*g*: Developing power supply circuits

The developing power supply circuits E1*y* to E1*g* apply developing voltage to the developing rollers of the developing devices Gy to Gg.

E2*y* to E2*g*: Charge power supply circuits

The charge power supply circuits E2*y* to E2*g* apply charge voltage to the chargers CCy to CCg.

E3*y* to E3*g*: Primary transfer power supply circuits

The primary transfer power supply circuits E3*y* to E3*g* apply primary transfer voltage to the primary transfer rollers T1*y* to T1*g*.

E4: Secondary transfer power supply circuit

The secondary transfer power supply circuit E4 applies secondary transfer voltage to the secondary transfer roller T2*b*.

E5: Fixing power supply circuit

The fixing power supply circuit E5 supplies heating power to the heating roller Fh.

D1: Crossed motor drive circuit

The crossed motor drive circuit D1 as an example of a skew drive source drive circuit drives the crossed roll Rc through the crossed motor M1.

D2: Crossed moving up and down circuit

The crossed moving up and down circuit D2 as an example of a skew contact/out of contact circuit moves up and down the moving up and down arm 11 through a moving up and down motor.

(Function of Controller C)

The controller C has function implementing means of a program for implementing the functions of executing processing responsive to the output signal from each of the signal output elements and outputting a control signal to each of the control elements. The function implementing means for implementing various functions of the controller C will be discussed below:

C1: Main motor rotation control means

The main motor rotation control means C1 as an example of a main drive source control means controls the main motor drive circuit D0 and controls rotation of the photoconductive bodies PRy to PRg, the developing rollers of the developing devices Gy to Gg, the fixing device F, etc.

C2: Power supply circuit control means

The power supply circuit control means C2 has the following means C2*a* to C2*e* and controls the power supply circuit E to control the developing voltage, the charging voltage, the transfer voltage, turning on/off a heater of the heating roller Fh, etc.:

C2*ay* to C2*ag*: Developing voltage control means

The developing voltage control means C2*ay* to C2*ag* control the operation of the developing power supply circuits E1*y* to E1*g* and control developing voltage applied to the developing rollers of the developing devices Gy to Gg.

C2*by* to C2*bg*: Charge voltage control means

The charge voltage control means C2*by* to C2*bg* control the operation of the charge power supply circuits E2*y* to E2*g* and control charge voltage applied to chargers CRy to CRg.

C2*cy* to C2*yg*: Primary transfer voltage control means

The primary transfer voltage control means C2*cy* to C2*yg* control the operation, of the primary transfer power supply circuits E3*y* to E3*g* and control transfer voltage applied to the primary transfer rollers T1*y* to T1*g*.

C2*d*: Secondary transfer voltage control means

The secondary transfer voltage control means C2*d* controls the operation of the secondary transfer power supply circuit E4 and controls secondary transfer voltage applied to the secondary transfer roller T2*b*.

C2*e*: Fixing Power Supply Control Means

The fixing power supply control means C2*e* controls the operation of the fixing power supply circuit E5 and controls turning on/off of the heater of the heating roller Fh to control the fixing temperature.

C3: Job control means

The job control means C3 as an example of image forming operation control means controls the operation of the latent image forming devices ROSy to ROSg, the photoconductive bodies PRy to PRg, the transfer rollers T1*y* to T1*g* and T2, the fixing device F, etc., and executes a job of the image forming operation.

C4: Skew correction control means

The skew correction control means C4 has drive start timing determination means C4A, medium position detection means C4B, drive signal input means C4C, driven moving up and down control means C4D, current control means C4E as an example of power supply control means, pre-excitation time storage means C4F as an example of reference current applying time storage means, third crossed arrival time storage means C4G as an example of heavy current applying time storage means, out-of-contact completion time storage means C4H as an example of reference current restoration time storage means, and a timer M1 as an example of time count means, and controls the skew correction device Sh.

C4A: Drive start timing determination means

The drive start timing determination means C4A determines whether or not the timing at which drive of the crossed motor M1 is started and drive of the crossed roll Rc is started comes. When the record sheet S is conveyed into the upstream overlap convey detector Jk, the drive start timing determination means C4A of Exemplary Embodiment 1 determines that the timing at which drive is started comes as an example.

C4B: Medium position detection means

The medium position detection means C4B detects whether or not the record sheet S arrives at the position of each of the sensors SN1 to SN4 based on the detection result of each of the sensors SN1 to SN4.

C4C: Drive signal input means

The drive signal input means C4C inputs a pulse as an example of a drive signal to the crossed motor M1 implemented as a pulse motor. The drive signal input means C4C of Exemplary Embodiment 1 starts input of the drive signal and drives the crossed motor M1 after a lapse of pre-excitation time period t1 after the drive start timing of the crossed motor M1 comes.

C4D: Driven moving up and down control means

The driven moving up and down control means C4D controls a moving up and down motor M2 to move up and down the driven roller 8. When the leading end of the record sheet S is caught in the registration roller Rr and starts to be conveyed, the driven moving up and down control means C4D of Exemplary Embodiment 1 moves the driven roller 8 to the up position, and moves the driven roller 8 to the down position before the trailing end of the record sheet S exits the third crossed roll Rc3 and the leading end of the subsequent record sheet S arrives at the first crossed roll Rc1.

C4E: Current control means

The current control means C4E as an example of drive power control means has weak current supply means C4E1, medium current supply means C4E2 as an example of reference current supply means, and heavy current supply means C4E3 as an example of high current supply means, and controls power supply to the crossed motor M1. The current control means C4E of Exemplary Embodiment 1 controls the drive force of the pulse motor, the current value concerning torque, and controls the toque of the pulse motor.

C4E1: Weak current supply means

The weak current supply means C4E1 supplies weak current as an example of pre-excitation current to the crossed motor M1. The weak current supply means C4E1 of Exemplary Embodiment 1 supplies the weak current i1 only until a lapse of the pre-excitation time period t1 since the drive start timing of the crossed motor M1 came.

C42E: Medium current supply means

The medium current supply means C4E2 supplies medium current i2 as an example of reference current. The medium current supply means C4E2 of Exemplary Embodiment 1 supplies the medium current i2 to the crossed motor M1 after a lapse of the pre-excitation time period t1.

C4E3: Heavy current supply means

The heavy current supply means C4E3 supplies heavy current i3 having a higher current value than the medium current i2 as an example of high current. The heavy current supply means C4E3 of Exemplary Embodiment 1 supplies the heavy current i3 at the timing at which the record sheet S comes in contact with the side guide 3.

A current value of the heavy current i3 is larger than a current value of the medium current i2. A current value of the medium current i2 is larger than a current value of the weak current i1.

C4F: Pre-excitation time storage means

The pre-excitation time storage means C4F stores the pre-excitation time t1 of the time period until pre-excitation terminates since drive of the crossed motor M1 is started.

C4G: Third crossed arrival time storage means

The third crossed arrival time storage means C4G stores third crossed arrival time t2 of the time until the third crossed roll Rc3 is reached since the leading end of the record sheet S was detected in the third crossed sensor SN3 as an example of high current applying start time.

C4H: Out-of-contact completion time storage means

The out-of-contact completion time storage means C4H stores out-of-contact completion time t3 of the time until the driven roller 8 completes moving the up position since starting to move the up position as an example of medium current restoration time.

TM1: Timer

Times t1 to t3 are input to the timer TM1 and the timer TM1 counts the times t1 to t3.

(Description of Flowchart of Exemplary Embodiment 1)

Next, a processing flow of the image forming apparatus U of Exemplary Embodiment 1 of the invention will be discussed with a flowchart.

(Description of Current Control Processing)

Figure 9:
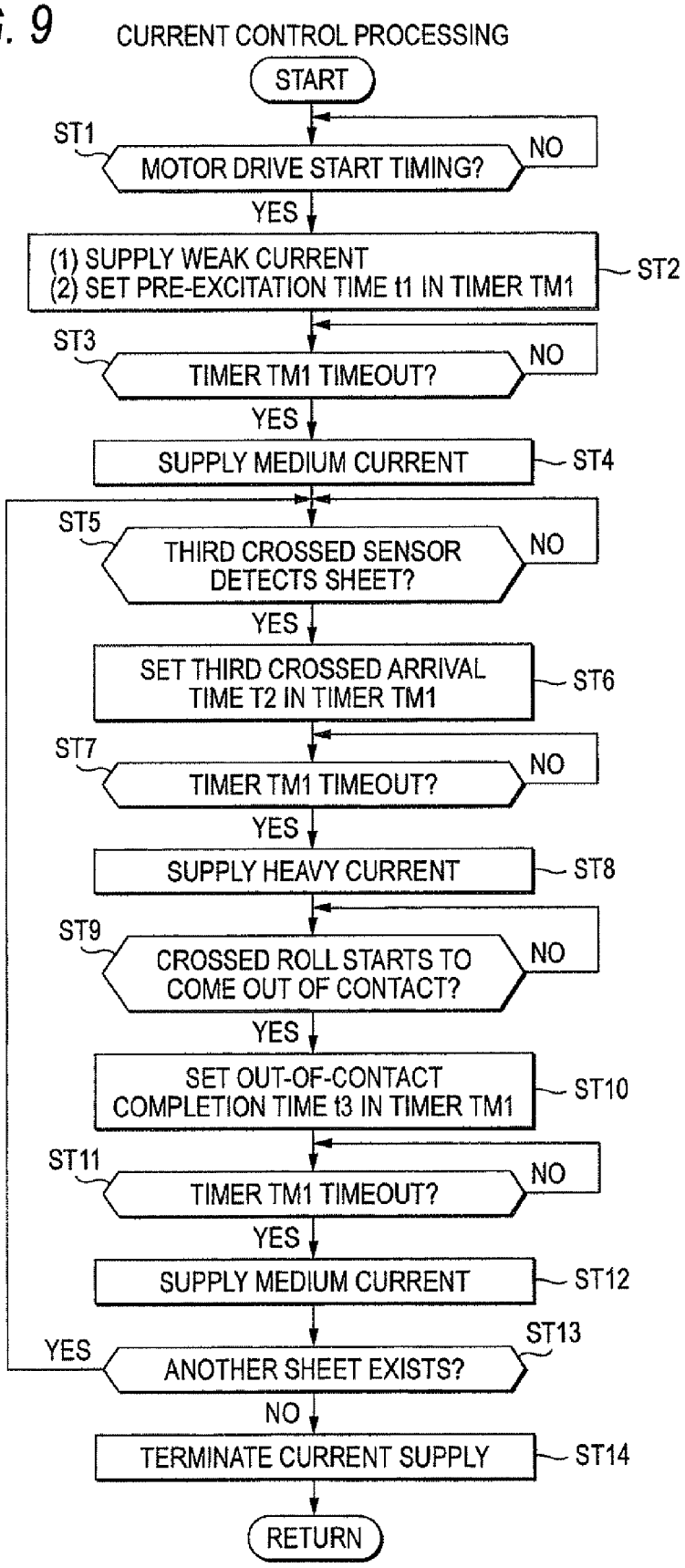
FIG. 9 is a flowchart of current control processing of Exemplary Embodiment 1.

FIG. 9 is a flowchart of current control processing of Exemplary Embodiment 1.

Processing of each ST (step) in the flowchart of FIG. 9 is executed in accordance with the program stored in the ROM of the control section C. The processing is executed as multitask concurrently with any other processing of the copier U.

The flowchart of FIG. 9 is started when the power is turned on.

At ST1 in FIG. 9, whether or not the drive start timing of the crossed motor M1 comes is determined. If the determination result is yes (Y), the process goes to ST2; if the determination result is no (N), ST1 is repeated.

At ST2, following (1) and (2) are executed and the process goes to ST3.

(1) Weak current it is supplied.

(2) The pre-excitation time t1 is set in the timer TM1.

At ST3, whether or not the timer TM1 times out, namely, the pre-excitation time t1 has elapsed is determined. If the determination result is yes (Y), the process goes to ST4; if the determination result is no (N), ST3 is repeated.

At ST4, the medium current i2 is supplied to the crossed motor M1. The process goes to ST5.

At ST5, whether or not the third crossed sensor SN3 detects the record sheet S is determined. If the determination result is yes (Y), the process goes to ST6; if the determination result is no (N), ST5 is repeated.

At ST6, the third crossed arrival time t2 is set in the timer TM1. The process goes to ST7.

At ST7, whether or not the timer TM1 times out, namely, the third crossed arrival time t2 has elapsed is determined.

If the determination result is yes (Y), the process goes to ST8; if the determination result is no (N), ST7 is repeated.

At ST8, the heavy current i3 is supplied to the crossed motor M1. The process goes to ST9.

At ST9, whether or not the driven roll 8 of the crossed roll Rc starts to come out of contact with the drive roll 6, namely, whether or not drive of the moving up and down motor M2 starts is determined. If the determination result is yes (Y), the process goes to ST10; if the determination result is no (N), ST9 is repeated.

At ST10, the out-of-contact completion time t3 is set in the timer TM1. The process goes to ST11.

At ST11, whether or not the timer TM1 times out, namely, the out-of-contact completion time t3 has elapsed is determined. If the determination result is yes (Y), the process goes to ST12; if the determination result is no (N), ST11 is repeated.

At ST12, the medium current i2 is supplied to the crossed motor M1. The process goes to ST13.

At ST13, whether or not another record sheet S to be conveyed to the skew correction device Sk exists is determined. That is, whether or not the job of the image forming operation is complete is determined. If the determination result is yes (Y), the process returns to ST5; if the determination result is no (N), the process goes to ST14.

At ST14, current supply to the crossed motor M1 is terminated. The process returns to ST1.

(Operation of Exemplary Embodiment 1)

Figures 10A, 10B, 10C:
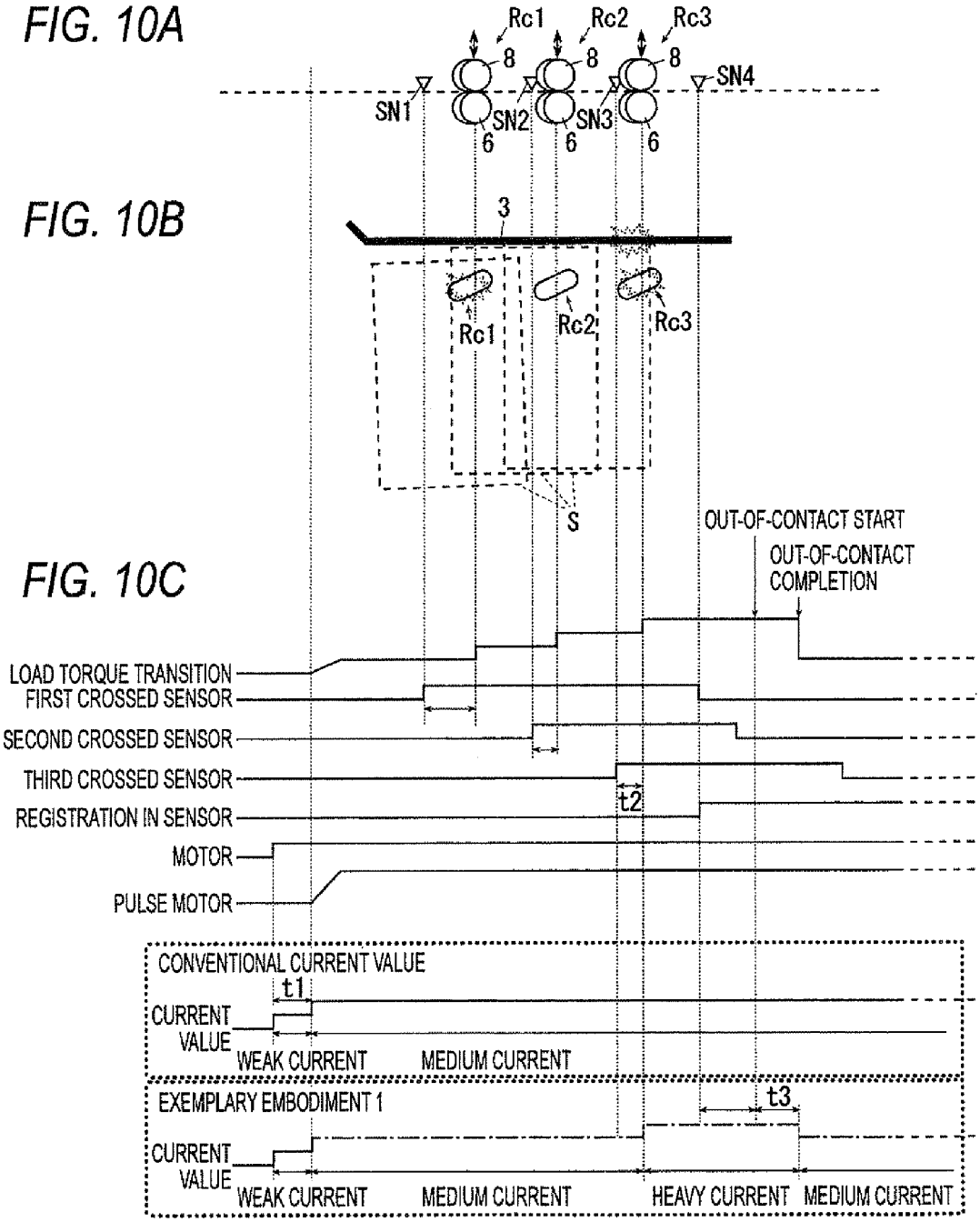
FIG. 10A is a main part side schematic representation of the crossed roll portion in Exemplary Embodiment 1.
FIG. 10B is a plan view of the crossed roll portion in Exemplary Embodiment 1.
FIG. 10C is a time chart in Exemplary Embodiment 1.

FIG. 10A is a main part side schematic representation of the crossed roll portion. FIG. 10B is a plan view of the crossed roll portion. FIG. 10C is a time chart.

In the image forming apparatus U of Exemplary Embodiment having the configuration described above, when the record sheet S is conveyed into the skew correction device Sk, the weak current i1 is supplied to one crossed motor M1 for driving the three crossed rolls Rc, pre-excitation is performed, the medium current i2 is applied, and drive is started. The record sheet S is detected in the upstream first crossed sensor SN1 and starts to be conveyed by the first crossed roll Rc1. At this time, the load torque acting on the crossed motor M1 rises with the conveying resistance of the record sheet S and the first crossed roll Rc1 conveys the record sheet S toward the side guide 3. While the record sheet S is conveyed only by the first crossed roll Rc1, the trailing end margin of the record sheet S is brought close to the side guide 3, but does not come in contact the side guide 3.

When the record sheet S starts to be conveyed with the second crossed roll Rc2, conveying resistance acts on the two crossed rolls Rc1 and Rc2 and the load torque further rises. The record sheet S is conveyed toward the side guide 3 with the two crossed rolls Rc1 and Rc2.

When the record sheet S starts to be conveyed with the third crossed roll Rc3, a side end of the record sheet S is abutted against the side guide 3, frictional resistance of the record sheet S and the side guide 3 accompanying the abutment also becomes conveying resistance, and the load torque becomes the largest.

At this time, in the conventional configuration, it is a general practice to use a DC servo motor; the DC servo motor involves a problem in that when load rises, the number of revolutions of the motor varies and variations occur in conveying performance. To use a pulse motor in the conventional control, while the crossed motor M1 is being driven, control is performed with a given current value except for pre-excitation and when the load torque becomes large, step out occurs and it is feared that the record sheet S may become unable to be conveyed. In contrast, in Exemplary Embodiment 1, supplied current is changed from the medium current i2 to the heavy current i3 in response to the load torque, step out is hard to occur, and conveying failure is decreased.

In Exemplary Embodiment, the driven roll 8 comes out of contact and the record sheet is not conveyed with the crossed roll Rc, the supplied current is restored from the heavy current i3 to the medium current i2. Therefore, heat generation of the crossed motor M1 to which the heavy current i3 continuously supplied, degradation of performance, and shortening the life are decreased and power consumption is suppressed. That is, in the conventional art in which the same current value is supplied, if the heavy current i3 is supplied at all times, there are problems of heat generation, performance degradation, lower life, and high power consumption, but the problems are solved in Exemplary Embodiment 1.

Further, in Exemplary Embodiment 1, the crossed cleaning blade 18 is in contact with the crossed roll Rc and removes a deposit, particularly a developer deposited on and fixed to the drive roll 6 at the double-side print time, etc., namely, the fixed developer. In a usual conveying member for conveying a medium in the medium conveying direction, if a developer is fixed to the surface, the medium can be conveyed with no effect to some extent because of the conveying speed from the upstream side. However, in a conveying member for conveying a medium in a skew manner, such as the crossed roll Rc, the record sheet S is conveyed in a skew manner and if friction lowers in a fixed developer, it is feared that skew correction may be unable to be made. In contrast, in Exemplary Embodiment 1, the crossed cleaning blade 18 removes the developer fixed to the drive roll 6 and occurrence of conveying failure because of lowering of frictional resistance of the crossed roll Rc is decreased. If a developer is fixed to the driven roller 8 performing driven rotation, the driven roller 8 is not driven and if the driven roller 8 slips with the record sheet S, a severe problem does not occur.

Particularly, the crossed cleaning blade 18 of Exemplary Embodiment 1 comes in contact with the drive roll 6 in the wiper direction and the tips of the drive roll 6 and the crossed cleaning blade 18 are hard to cut away because of wear as compared with the conventional art of contact in the doctor direction. Therefore, shortening the lives of the drive roll 6 and the crossed cleaning blade 18 and degradation of cleaning performance are decreased. Therefore, it is made possible to exclude the drive roll 6 and the crossed cleaning blade 18 from replacement components and the maintenance cost is also decreased.

In Exemplary Embodiment 1, the paper dust removal pad 17 is placed upstream from the crossed cleaning blade 18 and removes paper dust before cleaning is performed with the crossed cleaning blade 18. If the paper dust removal pad 17 is not provided, paper dust, etc., enters the contact area between the crossed cleaning blade 18 and the drive roll 6 and slip occurs because of paper dust and it is feared that the fixed developer may be unable to be removed. That is, in the conventional configuration in which paper dust is removed only with the cleaning blade, it is feared that the fixed developer may be unable to be removed although paper dust may be removed.

In contrast, in Exemplary Embodiment 1, paper dust is removed with the upstream paper dust removal pad 17 and the fixed developer is reliably and easily removed with the downstream crossed cleaning blade 18.

(Modified Examples)

While the exemplary embodiment of the invention has been described in detail, it is to be understood that the invention is not limited to the specific exemplary embodiment described above and various changes and modifications may be made without departing from the spirit and the scope of the invention as claimed. Modified examples (H01) to (H04) of the invention are illustrated below:

(H01) In the exemplary embodiment described above, the printer U is illustrated as an example of the image forming apparatus, but the image forming apparatus is not limited to the printer; for example, it may be implemented as a copier, FAX, or a multiple function device including all or some of the functions, etc.

(H02) In the exemplary embodiment described above, the configuration in which developers of six colors are used is illustrated as the printer U, the print U is not limited to it; for example, the printer U may be applied to a single-color image forming apparatus and a multicolor image forming apparatus of five colors or less or seven colors or more.

(H03) In the exemplary embodiment described above, the configuration in which current is controlled in two steps of medium current and heavy current is illustrated, the configuration is not limited to it; for example, current may be controlled in three steps or more.

(H04) In the exemplary embodiment described above, it is desirable that the paper dust removal pad 17 should be provided, but the paper dust removal pad 17 may also be omitted.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated.

It is intended that the scope of the invention be defined by the following claims and their equivalents.

DESCRIPTION OF REFERENCE NUMERALS

3: Side end alignment member
6: Drive member
8: Driven member
17: Upstream removal member
18: Removal member
Rc: Skew conveying member
S: Medium
Sk: Medium conveying device
U: Image forming apparatus
U1: Image record section.

What is claimed is:

1. A medium conveying device comprising:

an alignment member that faces one end of a medium and aligns the medium while contacting with the medium when the medium is conveyed in a first direction;

a skew conveying member that conveys the medium in a second direction crossing to the first direction so that the one end comes in contact with the alignment member and that includes a drive member and a driven member opposed to the drive member and driven by the drive member, a removal member that has a tip end coming in contact with a face of the drive member to remove a deposit on the face, and a base end being in contact with a support part which supports the removal member, the removal member being placed along a rotation direction of the drive member so that the tip end faces downstream of the rotation direction relative to the base end of the removal member, the removal member being placed so that the tip end faces a downstream side of the rotation direction of the drive member relative to a point at which the tip end is in contact with the drive member, and the tip end of the removal member moves in a direction away from the support part upon coming in contact with the face of the drive member, and the base end of the removal member becomes deformed in a direction away from the support part, and an upstream removal member that is placed upstream from the removal member relative to the rotation direction of the drive member and comes in contact with the face to remove a deposit on the drive member, wherein the support part supports both the removal member and the upstream removal member.

2. The medium conveying device according to claim 1, wherein the removal member includes:

a first face that includes the tip end;

a second face that intersects with the first face and is formed to be integral with the first face; and a medium conveying device main body to which the second face is fixed.

3. The medium conveying device according to claim 1, wherein the removal member includes:

a first face that includes the tip end and the other end; and a second face that intersects with the first face and is formed to be integral with the first face, another end of the first face that is formed integral to the second face does not contact to the face of the drive member.

4. The medium conveying device according to claim 1, wherein the removal member has a plate shape, and the tip end and the base end of the removal member are linearly located.

5. A medium conveying device comprising:

an alignment member that faces one end of a medium and aligns the medium while contacting with the medium when the medium is conveyed in a first direction;

a skew conveying member that conveys the medium in a second direction crossing to the first direction so that the one end comes in contact with the alignment member and that includes a drive member and a driven member opposed to the drive member and driven by the drive member, a removal member that has a tip end coming in contact with a face of the drive member to remove a deposit on the face, the removal member being placed along a rotation direction of the drive member so that the tip end faces downstream of the rotation direction, the removal member being placed so that the tip end faces a downstream side of the rotation direction of the drive member relative to a point at which the tip end is in contact with the drive member, and the tip end of the removal member moves to the downstream side upon coming in contact with the face of the drive member, wherein an angle of deformation formed by (i) a tangential line drawn from a contact point of the drive member and the removal member, and (ii) the removal member, is between approximately 15° to 45°, an upstream removal member that is placed upstream from the removal member relative to the rotation direction of the drive member and comes in contact with the lace to remove a deposit on the drive member, and a support part that supports both the removal member and the upstream removal member.

6. The medium conveying device according to claim 5, wherein the removal member includes:

a first face that includes the tip end;

a second face that intersects with the first face and is formed to be integral with the first face; and a medium conveying device main body to which the second face is fixed.

7. The medium conveying device according to claim 5, wherein the removal member includes:

a first face that includes the tip end and the other end; and a second face that intersects with the first face and is formed to be integral with the first face, another end of the first face that is formed integral to the second face does not contact to the face of the drive member.

8. The medium conveying device according to claim 5, wherein the removal member has a plate shape, and the tip end and a base end of the removal member are linearly located.

* * * * *